United States Patent [19]

Jung et al.

[11] Patent Number: 4,777,702

[45] Date of Patent: Oct. 18, 1988

[54] APPARATUS FOR SEPARATING FIBER MATERIAL FROM AN AIR CURRENT

[75] Inventors: Rolf R. Jung, Neubulach, Fed. Rep. of Germany; Akiva Pinto, Gastonia, N.C.; Gunter Lucassen, Haltern, Fed. Rep. of Germany

[73] Assignee: Hergeth Hollingsworth GmbH, Duelman, Fed. Rep. of Germany

[21] Appl. No.: 88,733

[22] Filed: Aug. 24, 1987

[30] Foreign Application Priority Data

Sep. 13, 1986 [DE] Fed. Rep. of Germany ..... 3631208

[51] Int. Cl.[4] ..... D01G 1/00

[52] U.S. Cl. ..... 19/200; 19/205

[58] Field of Search ..... 19/200, 204, 205

[56] References Cited

U.S. PATENT DOCUMENTS 1,942,868 1/1934 Mitchell ..... 19/204 X
4,258,455 3/1981 Werner ..... 19/200 X
4,479,286 10/1984 Brown et al. ..... 19/200
4,519,114 5/1985 Rhyne ..... 19/200
4,637,096 1/1987 Wise et al. ..... 19/205 X

*Primary Examiner*—Louis K. Rimrodt
*Attorney, Agent, or Firm*—Cort Flint

[57] ABSTRACT

A condenser (1) for separating fibers from a fiber laden air flow is disclosed which includes a cell wheel housing (3) and a cell wheel (4). The cell wheel includes a plurality of radial vanes (6) and a perforated screen (12) extending between adjacent vanes. The perforated screen separates the space between the adjacent vanes into fiber entraining cells (14) and air exit spaces (13). Flexible sealing element (7) are carried at the ends of vanes which seal against an interior of the wheel housing. Air from the fiber laden air flow exits through screens (12) by way of a discharge opening (18). Fibers are discharged at (9) through an opening provided in the bottom of cell wheel housing (3).

15 Claims, 3 Drawing Sheets

APPARATUS FOR SEPARATING FIBER MATERIAL FROM AN AIR CURRENT

BACKGROUND OF THE INVENTION

The invention relates to condenser apparatus for separating fiber material from an air current. In particular, the condenser dedusts textile fibers, old fibrous textile material, etc. The condenser conducts a fiber laden air current to a circulating element having screens through which the air exists, while the fiber material is entrained and dropped from the housing.

It has been known, for separating fiber material, etc., from an air current, to use screening drum separators whereby loose dust may also escape through said screening drum. Generally, the screening drum periphery of such separators is provided with longitudinally extending bars which entrain the material in the sense of rotation of the drum. The height of said bars being relatively low and the fiber material contained in the air current possibly also comprising larger flocks or clusters, the operation of the condenser may be affected by clogging or the like. To eliminate this risk, the side walls of the housing receiving the screening drum are formed as flaps which, in case of larger accumulations of material lumps, etc., may yield. As a result, the efficiency of the condenser, in particular dedusting of material, is considerably impaired. Further, inside the screening drum, shielding elements, i.e., so-called air shields have to be installed in order to ensure that the sucking effect is as uniform as possible over the length of the screening drum. The structural expenditure of the screening drum separator is relatively high and complicated. Due to the relatively low throughput volume conditioned by construction, the screening drum separator is operated at a relatively high speed.

An object of the invention is to provide condenser apparatus for the separation of fiber material from an air current which is of a simple design and reliable in operation, and yet is highly effective for separation and dedusting.

SUMMARY OF THE INVENTION

The apparatus includes a housing in which a cell wheel rotates. The cell wheel has cells subdivided by a transverse screening surface through which the air exits. An opening is provided in the upper half of the cell wheel housing on one or on both sides through which the exit air is conveyed.

As a result of the cell wheel design as the ciculating member of the condenser, a free space available for receiving material above the screening plate is much larger. The risk of clogging is eliminated. The condenser is more effective. The sucking effect is distributed over a larger surface between the vanes of the cell wheel. The material is placed more loosely on the screening surface thus improving substantially the dedusting effect. It is possible to operate with a higher material layer on the screening surface. The speed of the cell wheel is lower than in case of a screening drum separator. Taken in all, the production obtained is higher and the efficiency is higher as well. The manufacture of the cell wheel condenser is simpler than that of the screening drum condenser.

According to another feature of the invention, the screening surface is a planar screening plate set back in the cell space formed by the vanes. It favorably extends ascendingly in the sense of rotation from one cell wall to the other. By arranging the perforated plate set back between the cells, the material is conveyed in a relatively large cavity and does not contact either the external edges of the vanes of the cell wheel or the external sealing elements. The sealing effect is not impaired. Due to the relatively large space above the planar screening surface, a nep formation or balling of the fibers does not take place.

The acute-angled space near the axle of the cell wheel is advantageously provided with a transverse bulkhead at a distance from the axle so that dust and fiber accumulations are avoided in the center of the cell space.

The inlet opening for the fiber laden air current may be provided on the top side of the housing, or, preferably laterally at the cylindrical cell wheel housing. Preferably, the length of the inlet opening for the material containing air current is less than the length of the cell wheel housing. By this arrangement, the space above the screeing plate cannot be filled excessively, the this is quite important for the condenser effect.

The air exit opening is suitably provided at the end side of the cell wheel housing. Preferably, an exit opening is provided on both sides of the housing to thus improve substantially the absorbing effect.

The exhaust air channels joined to the exit openings may end in a channel extending paraxially to the housing axis and from which extends a discharge tube. Seen in cross section, the paraxial exhaust air channel is disposed in an upper corner of the external condenser jacket outside the cell wheel housing. Thus, a compact construction of the condenser may be obtained.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
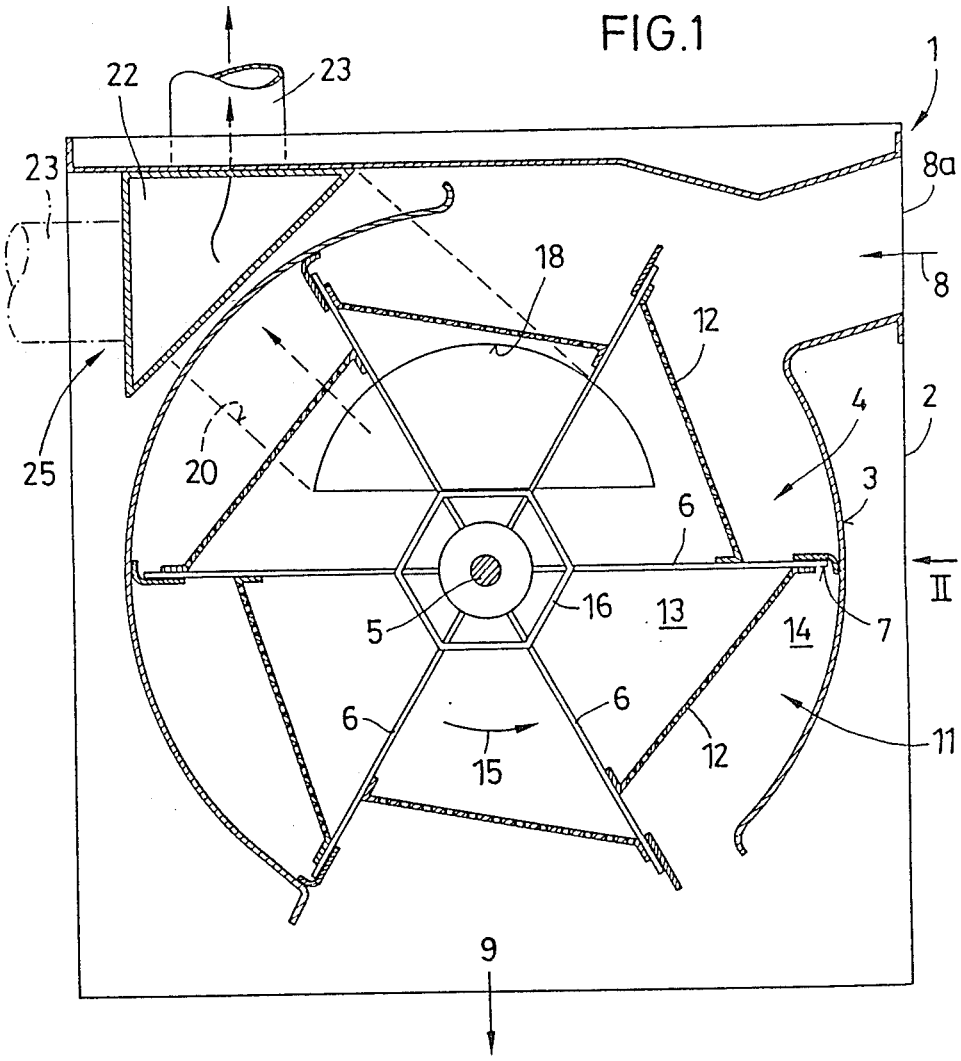
FIG. 1 is an elevational schematic view of the condenser apparatus of the invention.
Figure 2:
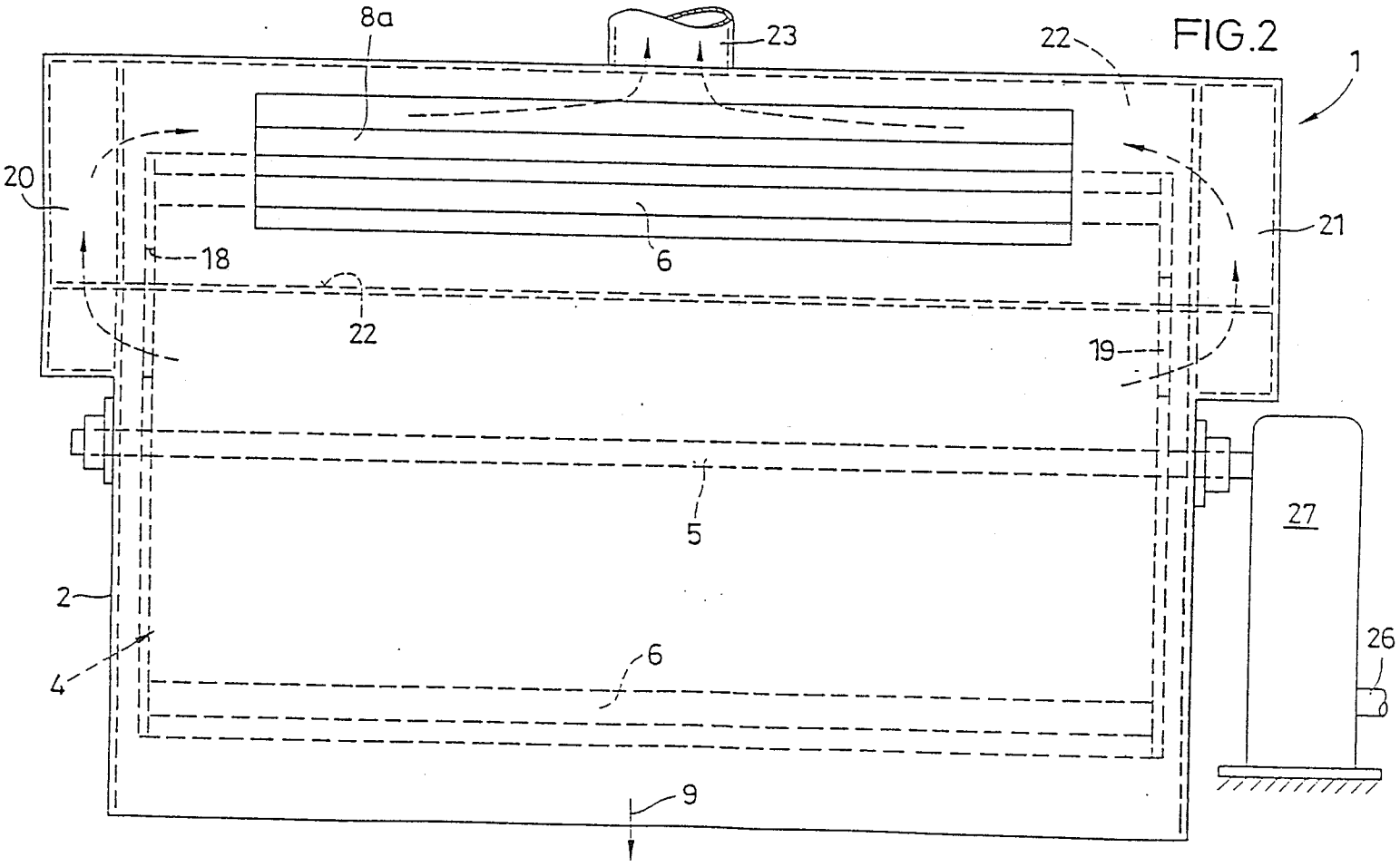
FIG. 2 is a schematic view of the condenser of FIG. 1 in direction of arrow II.
Figure 3:
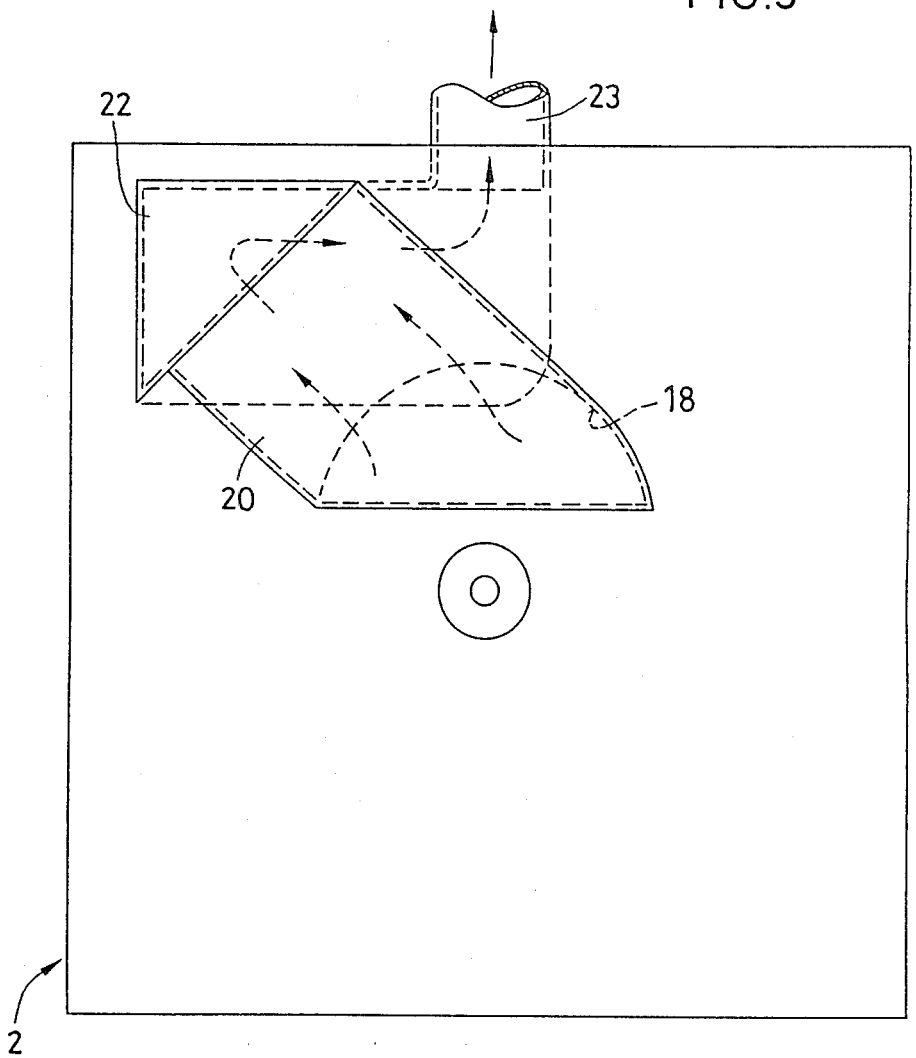
FIG. 3 is a schematic detail of the position of the exhaust air channel with respect to the cell wheel housing.

The apparatus 1 for separating fiber material from a fiber laden air current includes a cell wheel assembly having a cell wheel 4 enclosed within a cylindrical housing 3. Cell wheel 4 is a circulating member which is caused to rotate by a drivable shaft 5. The cell wheel comprises radially extending vanes 6 having sealing elements 7 carried at their external border which slide along the inner circumference of housing 3. The sealing elements may be flexible sealing flaps of plastic or the like which engage under tension with deflected edges against the inner circumference of housing 3. A material feed duct 8 is provided at one side of a housing jacket 2. Feed may be also performed from the top into the cell wheel 4. The length of an inlet opening 8*a* is suitably somewhat less than the length of the cell wheel housing 3 such as illustrated in FIG. 2. The resultant advantage is that an overfilling of the cell chamber is substantially avoided. Reference numeral 9 marks a discharge opening for the material in the lower part of housing 3.

A perforated transverse screening surface 12 divides cell chamber 11 into an inner air exit space 13 and an external fiber entraining space 14 which provides a filling chamber. The screening surface 12 forms the bottom of the filling chamber 14 for instance as a planar perforated plate. The screening surface 12 is set back in the cell chamber 11. As seen in the sense of rotation 15 of the cell wheel 4, surface 12 suitably extends ascendingly from one vane wall 6 to the other vane wall. The material being conveyed in the chamber is of such a depth that it does not contact the external sealing elements 7. The acutely shaped space 13 between the vanes 6 is preferably covered by a transverse bulkhead 16 to exclude the accumulations of dust and fibers in the center of inner space 13.

The exit opening 18 for the absorbed air is adjacent one end of the cell wheel housing 3. Preferably, each end of housing 3 is provided with an exit opening 18 or 19 extending over three cell spaces 11. The exit openings 18, 19 are joined by lateral channels 20, 21 which end in a common exhaust air channel 22 extending paraxially to the shaft of the cell wheel 4. From exhaust air channel 22, discharge tube 23 extends to a (non-illustrated) vacuum source such as a blower. However, it is also possible to position the discharge tube 23 at the side of the exhaust air channel 22 (such as indicated by short lines), or in a central diagonal point.

In a preferred embodiment, exhaust air channel 22 is provided in the upper corner of the housing jacket 2 above cell wheel housing 3, thus allowing a compact construction of the condenser.

Shaft 5 of the vane wheel is driven by a motor 26 by the interconnection of a gear 27 box of a central gear type. Gear 27 may be so operated by corresponding control members so that a free screening surface is available for a satisfactory dedusting and so that the flocks may be maintained in a constant size.

The condenser of the cell wheel design offers the possibility of operating with suction or pressure, i.e., with overpressure or with vacuum. The sealing of the disclosed condenser is relatively simple so that secondary air may be practically excluded. The cell wheel condenser is operated at a relatively low speed. A balling of the fibers does not occur. During the slow operation, clogging must not be feared either. Further the obtainable production is high.

While a preferred embodiment of the invention has been described using specific terms, such description is for illustrative purposes only, and it is to be understood that changes and variations may be made without departing from the spirit or scope of the following claims.

What is claimed is:

1. Condenser apparatus for separating and dedusting textile fibers and the like from an air current of the type which includes a circulating element to which a fiber laden air current is conducted having screens through which said air exits while the fiber material is separated and dropped, characterized in that the circulating element includes:

(a) a cell wheel:

(b) transverse perforated screening surfaces dividing said cell wheel into individual cells;

(c) said screening surfaces providing an exit for the air of said fiber laden air current; and (d) a cell wheel housing having an air outlet opening communicating with said cell wheel for conveying said exit air away from said housing.

2. Apparatus according to claim 1, wherein said cell wheel includes radially extending vanes, said screening surfaces are arranged set back along the vanes into the cells to define fiber entraining cell chambes, and said screening surfaces extend in an ascending manner from one vane to the other in the direction of rotation of said cell wheel.

3. Apparatus according to claim 1 including an inlet opening filled with fiber laden air current leading into said cell wheel housing in a generally horizontal direction.

4. Apparatus according to claim 3, wherein said inlet opening has a length less than the length of said cell wheel housing.

5. Apparatus according to claim 1 including flexible sealing elements carried at an outer edge of said vanes.

6. Apparatus according to claim 5, wherein said flexible sealing elements flex in a folding manner to seal against an interior surface of said cell wheel housing.

7. Apparatus according to claim 1 including a transverse bulkhead in each cell forming an enclosure surrounding a rotary shaft of said cell wheel, said bulkhead forms with said vanes and a rear surface of said screens and acute angled air exit cell chamber.

8. Apparatus according to claim 1 including air outlet openings formed at opposing ends of said cell wheel housing.

9. Apparatus accoding to claim 1 including an exhaust air channel adjoining said air outlet openings extending parallel to the axis of said cell wheel housing and discharge tubes leading from said exhaust air channels to an outside environment.

10. Apparatus according to claim 9, wherein said parallel axially ascending exhaust air channel is arranged in an upper corner of a housing jacket of rectangular crosssection in which said cylindrical cell wheel is housed.

11. Condenser apparatus for separating textile fibers and the like from a fiber laden air current comprising:

(a) a cylindrical cell wheel housing;

(b) a cell wheel enclosed within said housing which includes a plurality of radial vanes;

(c) a plurality of perforated screens extending between adjacent radial vanes in an ascending manner in the direction of rotation of said cell wheel;

(d) said perforated screens extending between adjacent radial vanes forming fiber entraining cells on one side of said screens and forming air exit spaces on the opposing side of said screens;

(e) means for conveying said fiber laden air current to said perforated screens through which said air exits while said fibers are separated by said perforated screen and entrained in said fiber cells; and (f) means for conveying air exiting through said perforated screens away from said cylindrical wheel housing.

12. Apparatus according to claim 11 including flexible sealing elements carried by outer edges of said vanes engaging against an interior wall of said cylindrical wheel housing.

13. Apparatus according to claim 11 including a fiber discharge opening in said cylindrical wheel housing through which said entrained fibers are discharged from said housing.

14. Apparatus according to claim 11, wherein said means for conveying exit air away from said wheel housing includes exhaust air channels communicating with said exit cell chambers.

15. Apparatus according to claim 11 including a transverse bulkhead extending between adjacent radial vanes forming an enclosure about a rotary axis of said cell wheel on one side and forming an acute angled wall enclosure opposite said perforated screen in each exit air cell chamber.

* * * * *